United States Patent [19]

Klepesch

[11] Patent Number: 4,529,354

[45] Date of Patent: Jul. 16, 1985

[54] TOTAL FLOW TURBINE

[76] Inventor: Philip H. Klepesch, 5859 Sagebrush Rd., La Jolla, Calif. 92037

[21] Appl. No.: 501,390

[22] Filed: Jun. 6, 1983

[51] Int. Cl.[3] ..... F01D 1/34

[52] U.S. Cl. ..... 415/71; 415/90; 415/202

[58] Field of Search ..... 415/71, 76, 90, 158, 415/202

[56] References Cited

U.S. PATENT DOCUMENTS 224,270 2/1880 Brooks ..... 415/158
1,256,231 2/1918 Hough ..... 415/76 UX

FOREIGN PATENT DOCUMENTS 512275 1/1921 France ..... 415/71
1561084 2/1980 United Kingdom ..... 415/202
128235 11/1959 U.S.S.R. ..... 415/90

*Primary Examiner*—Robert E. Garrett
*Assistant Examiner*—Joseph M. Pitko
*Attorney, Agent, or Firm*—Baker, Maxham, Callan & Jester

[57] ABSTRACT

A total flow turbine includes a housing defining a rotor chamber with a rotor rotatably mounted within the chamber and includes a plurality of passages opening at an outer radial face of the rotor and spiraling in a converging fashion inward to a central cavity which communicates with an outlet from the housing, with a plurality of nozzles spaced around the periphery of the housing angled toward the rotor for directing fluid toward the inlet of the passages.

7 Claims, 4 Drawing Figures

TOTAL FLOW TURBINE

BACKGROUND OF THE INVENTION

The present invention relates to fluid turbines and pertain particularly to an improved multiphase fluid turbine.

Conventional fluid turbines designed for conventional steam operation are unsatisfactory for direct geothermal source operation. Geothermal wells contain an enormous source of energy which may be tapped for energy purposes. The difficulty with tapping such energy source, however, is that the steam available from such geothermal wells is typically wet and contains a great deal of solid matter in the form of salts and the like.

The energy from such wells is typically processed through scrubbers or heat exchanges prior to the utilization in steam turbines. This results in enormous expense of installation of equipment as well as waste of the available energy.

The present invention was developed and designed primarily to overcome such problems although it has application to and is usable with other sources of fluid.

It is therefore desirable that an improved system be available which can be utilized with geothermal sources of liquid and steam energy as well as other motive fluids.

SUMMARY AND OBJECTS OF THE INVENTION

It is therefore the primary object of the present invention to provide an improved fluid turbine capable of direct application of geothermal fluids.

In accordance with the primary aspect of the present invention, a turbine comprises a housing having a generally cylindrical chamber in which is rotatably mounted a rotor having a plurality of fluid passages extending from outer inlet ports to an inner collection chamber with a plurality of nozzles spaced around the periphery of the housing for injecting a fluid generally tangential to the rotor into the inlets of the fluid passages within the rotor.

BRIEF DESCRIPTION OF THE DRAWINGS

The above and other objects and advantages of the present invention will become apparent from the following description when read in conjunction with the drawings wherein.

DETAILED DESCRIPTION OF THE PREFERRED EMBODIMENT

Figure 3:
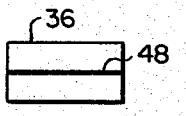
FIG. 3 is a section view taken generally on line 3—3 of FIG. 1.
Figure 4:
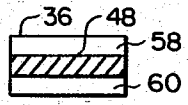
FIG. 4 is a section view taken generally on line 4—4 of FIG. 1.
Figure 2:
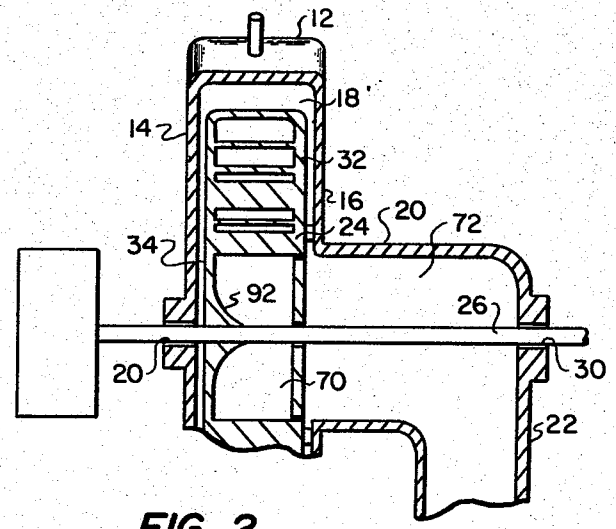
FIG. 2 is a partial side elevational sectional view of the turbine of FIG. 1.
Figure 1:
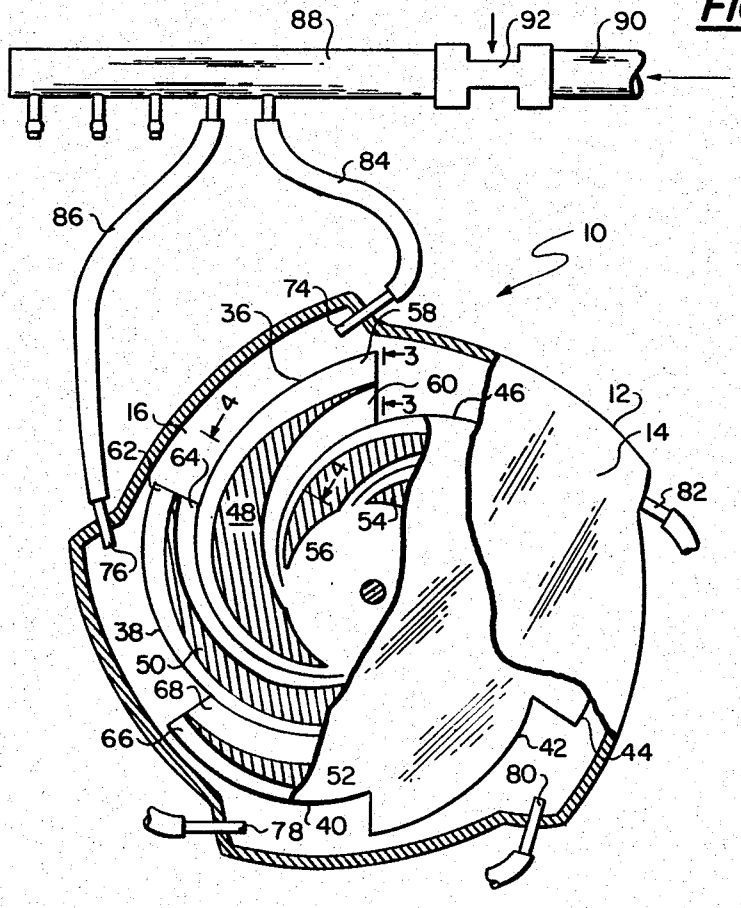
FIG. 1 is an elevation view partially in section of a turbine in accordance with the invention.

Referring to FIG. 1 of the drawing, a turbine in accordance with the invention is illustrated and designated generally by the numeral 10. The turbine includes a housing having a generally cylindrical configuration defined by an outer somewhat tooth-shaped peripheral wall 12 and a pair of end walls 14 and 16 enclosing and defining a somewhat cylindrical rotor chamber 18.

The housing includes a central outlet opening from the chamber 18 defined by a generally tubular axial extension 20 of the housing in which is formed an outlet or exhaust passage 22.

A rotor 24 is rotatably mounted on a drive shaft 26 rotatably mounted within journal bearings 28 and 30 in the walls 14 and 22 of the housing. The rotor has a somewhat cylindrical or circular sawtooth configuration as shown in FIG. 1. The rotor is constructed of a plurality of identical stepped fluid passage modules defined essentially by a pair of circular end plates 32 and 34 enclosed at the outer periphery by means of a plurality of overlapping spiral outer wall panels 36, 38, 40, 42, 44 and 46. These step spiral outer walls overlap to the extent of approximately two-thirds of the adjacent outer wall. Disposed between the end walls and each adjacent outer wall is a plurality of wedge-shaped central wall sections 48, 50, 52, 54 and 56 only five of which is shown. These in combination with the outer walls form pairs of spiral passages only three pair of which are shown 58, 60, 62, 64, 66 and 68.

These spiral passages have an inlet at the outer periphery of the rotor that opens or extends at right angles to a radial therethrough or essentially tangential to the rotor at the opening thereof and spiral inward to open into an internal collection chamber or passage 70 which opens into an outlet or exhaust passage 72 formed by the housing extension portions 20, 22. These spiral passages are progressively restricted from the outer end (inlet) to the inner end (outlet).

The outer housing as previously explained, forms a somewhat saw-toothed configuration conforming somewhat to that of the rotor, however, in a preferred arrangement having one less node or inlet nozzle than passageways in the rotor. This, as will become apparent later, provides an arrangement wherein at least one of the passages face directly into an incoming nozzle at all times.

The housing is shaped as illustrated with a plurality of nodes having a plurality of inlet nozzles 74, 76, 78, 80 and 82 directed inward into the housing or rotor chamber at an angle of on the order of about 45 degrees to a radial at the nozzle outlet. This presents the nozzle at an angle that puts it approximately tangential to the outer diameter or median diameter of the rotor at the point of maximum engagement or impact with the inlet to the respective fluid passages within the rotor.

The nozzles are connected by a plurality of inlet lines only two of which are shown, 84 and 86, to a manifold 88 which is supplied a motive fluid by a supply line 90. A control valve 92 is provided for controlling or throttling the flow of fluid into the turbine.

The turbine rotor configuration above described provides an arrangement of passages that imposes a forced vortex flow of fluid injected from the nozzles into the inlet to the passages. This flow extends substantially parallel to the periphery of the chamber and in view of the converging nature of the passages imparts a rotary motion to the rotor. The energy from the high pressure fluid is rapidly imparted to the rotor through frictional engagement with the walls of the passageway as the fluid is forced into the converging passages and moves toward the center of the rotor into the collection chamber 70. The contact of the fluid flow with the fluid channel walls as it flows through the channels in the rotor results in a boundary layer drag causing the energy from the fluid to be transferred to the turbine rotor forcing the rotor to rotate. The high frictional drag of the layer of fluid adjacent the walls of the passage is termed boundary layer drag, and quickly transfers the energy from the fluid to the rotor. In addition to the boundary layer drag, the progressive restriction of the passage also transfers energy from the flowing fluid as it flows through the passage. This imposes a driving force on the rotor extracting the energy from the high pressure fluid injected through the passages from inlet nozzles.

The source of fluid for driving the turbine may be any suitable source of fluid. However, the present turbine was designed with the source of geothermal fluid being of primary interest. The gas/steam conditions of typical geothermal sources of fluid frequently include suspended particles which would easily pass through the turbine passages due to the clearance. Entrained gasses in the fluid would expand along with the water for example as it passes out of the injection nozzles passing into the chamber toward the inlets of the respective fluid passages within the rotor.

Each of the fluid channels extend through a radius around the axis of the rotor of approximately 150 degrees. Adjacent pairs of channels overlap adjacent pairs by approximately two-thirds.

Fluid passing through the passage into the collection chamber 70 has given up some energy and is moving in a direction or spiral along with the rotor and is diverted by a diverter 92 having a generally conical configuration extending axially along the collection chamber 70 toward the outlet from the housing.

While I have illustrated and described my invention by means of a specific embodiment, it is to be understood that numerous changes and modifications may be made therein without departing from the spirit and scope of the invention as defined in the appended claims.

I claim:

1. A total flow fluid turbine comprising:

a housing defining a chamber;

a rotor having a plurality of radial faces on the outer periphery thereof rotatably mounted in said chamber and having a central chamber;

said rotor having a plurality of unobstructed converging passages having an inlet at and extending from said radial faces at the outer diameter of said rotor and spiraling and converging inward to an outlet at said central cavity, where a pair of said passages have an inlet in each of said radial faces and said pair of passages are of an unequal length;

outlet means communicating with said central cavity; and a plurality of fluid nozzles spaced about the periphery of said housing for directing an impelling fluid toward the inlet of said passages.

2. The turbine of claim 1 wherein said fluid nozzles extend at an angle of greater than about 20 degrees to a radial line from the axis of said rotor therethrough.

3. The turbine of claim 1 wherein said fluid nozzles and said passages differ in number.

4. The turbine of claim 3 wherein said passages are greater in number than said nozzles.

5. The turbine of claim 1 wherein said passages each overlap an adjacent passage.

6. The turbine of claim 5 wherein one of each pair of passages extends through an angle of about 150 degrees about the rotor.

7. The turbine of claim 5 wherein said outlet means is concentric to the axis of the rotor.

* * * * *